United States Patent [19]

Boyce et al.

[11] Patent Number: 4,934,308

[45] Date of Patent: Jun. 19, 1990

[54] IMPROVED SPRAY CHAMBER FOR POWDER DEPOSITION

[75] Inventors: Geoffrey M. Boyce, London, England; Ferdinando Trevisan, Verona, Italy

[73] Assignee: Volstatic Limited, London, England

[21] Appl. No.: 294,953

[22] PCT Filed: Jul. 28, 1986

[86] PCT No.: PCT/GB86/00447

§ 371 Date: Mar. 30, 1987

§ 102(e) Date: Mar. 30, 1987

[87] PCT Pub. No.: WO87/00771

PCT Pub. Date: Feb. 12, 1987

Related U.S. Application Data

[63] Continuation of Ser. No. 042,945, Mar. 30, 1987, abandoned.

[30] Foreign Application Priority Data

Jul. 29, 1985 [IT] Italy ..... 84941 A/85
Apr. 16, 1986 [GB] United Kingdom ..... 8609319

[51] Int. Cl.[5] ..... B05B 15/12

[52] U.S. Cl. ..... 118/326; 118/DIG. 7; 98/115.2; 55/DIG. 46

[58] Field of Search ..... 118/70, 309, 326, 634, 118/DIG. 7; 98/115.2, 115.3; 55/DIG. 46

[56] References Cited

U.S. PATENT DOCUMENTS

| | | | |
|---|---|---|---|
| 3,071,060 | 1/1963 | Forshee | 98/115.2 |
| 3,252,401 | 5/1966 | Smith | 118/326 X |
| 3,870,016 | 3/1975 | Schneider | 118/326 X |
| 3,905,785 | 9/1975 | Fabre | 118/634 X |
| 3,942,420 | 3/1976 | Marino | 118/326 X |
| 4,323,030 | 4/1982 | Lehmann, Jr. | 118/326 X |
| 4,402,279 | 9/1983 | Witte et al. | 118/326 |

FOREIGN PATENT DOCUMENTS

| | | | |
|---|---|---|---|
| 0021209 | 1/1981 | European Pat. Off. . | |
| 0200681 | 11/1986 | European Pat. Off. | 98/115.2 |
| 0828032 | 1/1952 | Fed. Rep. of Germany | 98/115.2 |
| 2704497 | 8/1978 | Fed. Rep. of Germany | 118/DIG. 7 |
| 0657865 | 4/1979 | U.S.S.R. | 118/326 |

OTHER PUBLICATIONS

Patent Abstracts of Japan, vol. 8, No. 232 (C-248) (1669), 25 Oct. 1984.

*Primary Examiner*—Shrive Beck
*Assistant Examiner*—Alain Bashore
*Attorney, Agent, or Firm*—Frost & Jacobs

[57] ABSTRACT

Sheet material is fed from a sheet supply station to a sheet receiving station and is guided by guiding means which define the floor as well as the side walls of a spray chamber. The sheet material can be replaced when soiled by advancing a new length from the supply station to the receiving station.

9 Claims, 7 Drawing Sheets

IMPROVED SPRAY CHAMBER FOR POWDER DEPOSITION

This is a continuation of application Ser. No. 042,945, filed Mar. 30, 1987, now abandoned.

TECHNICAL FIELD

The present invention relates to a powder deposition apparatus for the application of surface coatings formed by powder products.

BACKGROUND ART

As is known, painting with paint powders is carried out by spraying the paint powders, which may or may not be electrostatically charged, onto the product to be painted making use of appropriate spraying devices. Spraying is generally carried out in a booth through which the products to be painted are caused to pass.

Within each booth it is possible, inter alia, to intercept the paint powder which has not been deposited on the painted products. For this purpose, paint spray booths generally communicate with a suction unit comprising appropriate traps such as cyclone traps, filters and the like for the recovery of paint powder which has been sprayed but not utilised and is present in the air inside the booth.

The removal from each booth of paint which has not been removed by the suction unit and has stuck to the internal walls of the booth poses a problem which is more difficult to resolve. In addition, whenever it is desired to change the paint being used, for example to change to a different paint colour, the interior of the booth must be completely cleaned to avoid contamination and therefore substantial defects in the painted surfaces.

If carried out manually, correct cleaning of the interior of industrial paint spray booths takes a considerable amount of time, usually a few hours; cleaning is therefore very expensive in terms of labour costs and, in particular, the long down times which are entailed.

A number of solutions intended to partly automate the cleaning of booths have been proposed in the past to reduce down times. One of these solutions discloses a booth having a base equipped with scraper blades operated by a motor for the transportation of the paint powder to a removal aperture. Leaving aside the fact that a cabin of this type is structurally complicated and entails high production and operating costs, it does not provide a satisfactory solution to the problem outlined above since manual cleaning of the side walls of the booth ceiling is necessary.

Paint spray booths have also been designed with side walls and a base and ceiling formed by endless belts which may be displaced on return rollers, at least one of which is motorised. When the interior of the booth has to be cleaned, the endless belts are moved and carry the wall soiled with paint out of the booth and simultaneously replace it with a clean wall. In this case, it is necessary, however, to provide a suction device and possibly a scraper outside of each endless belt to collect and remove the paint powder adhering to the endless belt section which has just emerged or is emerging from the booth. This leads to a relatively complex structure entailing high operating costs which is unable to carry out satisfactory cleaning.

A paint spray booth with side walls formed by an unrolled and suspended belt which has to be rewound and disposed of when it is desired to change to a different paint or a different colour in the booth has also been proposed. This solution substantially reduces cleaning times for the booth, but the booth still requires costly accessories for the cleaning of the floor and/or ceiling.

US-A-3 811 371 discloses the use of a filter material as a side wall of the booth, air being extracted from the booth through the filter material. The filter material is mounted between a supply station and a receiving station and a new length of filter material is placed in position to define the wall when the original length becomes laden with paint. No attempt is made to provide a renewable coating for the ceiling or floor of the booth.

US-A-4 323 030 discloses endless belts defining the ceiling and side walls of a chamber, the endless belts being of non-permeable material, a portion of which being moved from an operative position defining the chamber to a non-operative position in which it is cleaned, readied for re-use. It may not be a practical proposition to re-use cleaned lining material and the described apparatus describes a filter material defining the floor of the chamber through which air is drawn as described in the preceding paragraph.

DE-OS 2 704 497 describes a paint spray booth comprising a framework, a supply of sheet material, a sheet material station, and means for guiding said sheet material from the supply to the receiving station along a path which defines the side walls of the spray chamber. The path does not define the floor of the chamber, over which is provided a separate filter belt which is guided in an endless path along the floor, the chamber and over a suction cleaning trough. Thus separate drive arrangements have to be provided for the sheet material defining the side walls of the booth and the filter material defining the floor of the booth.

An object of the present invention is to provide an industrial spray booth for the application of paint powders which may be cleaned in a very simple and more or less automatic manner with minimal down or dwell times of a few minutes.

A further object of the present invention is to design the booth such that it enables the continuous removal of the majority of the paint powder which collects therein during use without the need for complicated or costly appliances or devices for correct operation.

DISCLOSURE OF INVENTION

The present invention is characterised over the arrangement described above in that the guiding means guides the sheet material along a path which defines not only the side walls but also the floor of the spray chamber within the framework. With this arrangement, only one drive arrangement is required to provide new material over the floor and the side walls of the spray booth. Conveniently, the sheet material also defines the ceiling of the booth.

The sheet material is preferably non-permeable and may be a plastics material such as polyethylene.

An example of the invention will now be described with reference to the accompanying drawings.

BEST MODE FOR CARRYING OUT THE INVENTION

Figure 1:
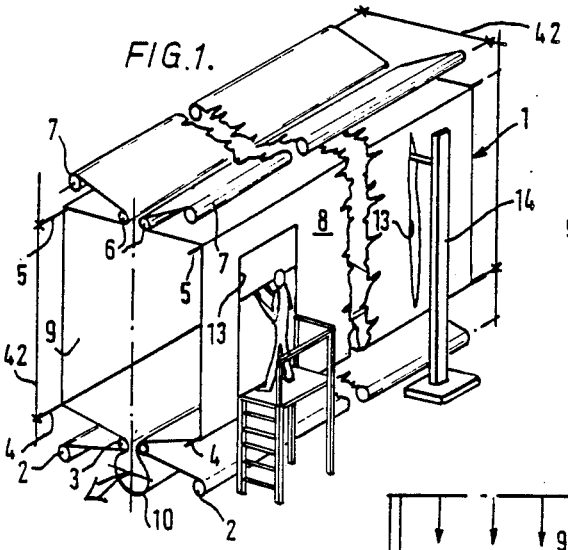
FIG. 1 is a diagrammatic perspective view from the top of a paint spray booth.
Figure 3:
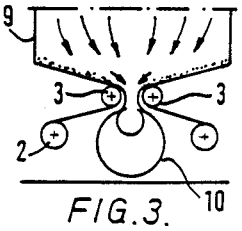
FIG. 3 is a side view from the left-hand side of FIG. 2.
Figure 2:
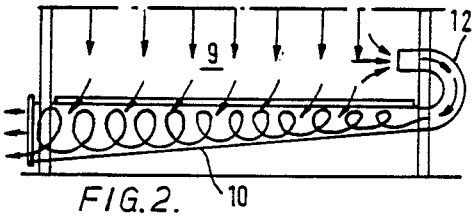
FIG. 2 is a diagrammatic view in longitudinal section of the lower portion of the booth of FIG. 1.

The booth illustrated in FIGS. 1 to 3, comprises two groups of rollers and supports disposed symmetrically on a framework with respect to a longitudinal vertical plane along the line x—x. The groups of rollers are mounted to rotate about respective fixed longitudinal axes on a support structure (not shown). Each group of rollers and longitudinal supports comprises a roller or lower lateral cylinder 2, a roller 3 disposed in the proximity of the plane x—x, a lower lateral cable or bar 4, an upper lateral cable or bar 5, a roller or upper central return cylinder 6 and an upper lateral roller 7. The spacing between the upper rollers 6 is such as to enable the passage of an appropriate means (not shown) for conveying the product to be coated through the booth, while a suction slot or space 11 extends between the lower rollers 3.

Figure 8:
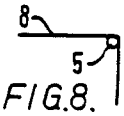
FIG. 8 shows a return cable in the booth of FIGS. 1 and 7.

The roller groups described above define a respective path which extends from the lower lateral rollers 2 to the central rollers 3 and from these to the bars or cables 4 and 5 and then to the upper central rollers 6 and to the lateral rollers 7. Along these paths there is stretched a respective sheet or strip of flexible material 8, 9, for example a sheet of fire-resistant polyethylene, which may be unwound from the rollers 2 and wound about the rollers 7 at the top or vice versa. The preferred arrangement is that the supply roller is at the top and the take-up roller at the bottom, to facilitate removal of the soiled sheeting. The strips or sheets 8 and 9 define the side walls and a respective portion of both the ceiling and the base of the booth. As can be seen, the base portion formed by the sheets or strips 8 and 9 is inclined with respect to horizontal towards the central space 11 between the rollers 3. It can also be seen that the sheets 8 and 9 are returned outwardly by rollers and inwardly by cables or bars 4 and 5. This is because it is necessary to provide an inward return component which is as small as possible inside the booth, since (see FIG. 8) this component is not shielded by the sheets or strips and so may be soiled or covered in some way with paint and has to be cleaned whenever necessary and must therefore have a very small external surface area to enable rapid cleaning.

Below the rollers 3 there is disposed a conduit 10 whose diameter increases from one end, where it has an elbow 12 penetrating into the booth at a certain level above the slot 11, to the other (FIG. 2). The conduit 10 communicates with the longitudinal slot 11 in the vicinity of the space between the two rollers 3 as a result of which it communicates directly with the lowermost longitudinal section within the booth. Outside of the booth the conduit 19 is connected to a unit for suctioning, conveying and recovering the materials suctioned from the booth.

Openings 13 may be cut through the sheets or strips through which opening it is possible to insert or possibly control apparatus for the application of the powder coatings to the products passing through the booth. As shown in FIG. 1, the control of this apparatus may also be carried out automatically by robots 14.

Figure 4:
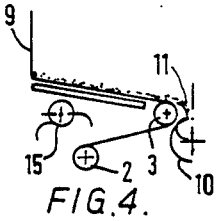
FIGS. 4, 5 and 6 are part views similar to FIG. 3 showing various means for removing or moving the powder along a base section of the booth.
Figure 5:
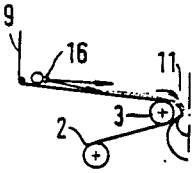
Figure 7:
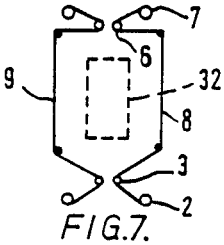
FIG. 7 is a cross-sectional diagrammatic view on a reduced scale of the booth of FIG. 1.
Figure 6:
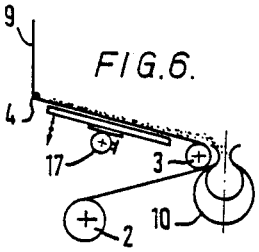
Figure 10:
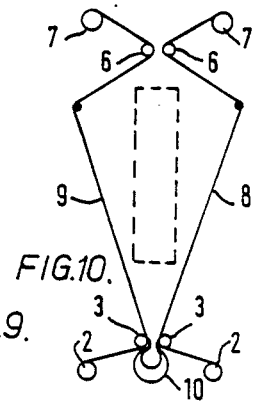

During a powder coating operation, the powder which has not stuck to the components to be coated or to the internal walls of the booth collects on the floor and may be conveyed to the space 11 between the rollers 3 to be collected in the conduit 10 as a result of the inclination of the base as shown, for example, in FIG. 10. This conveyor operation more frequently requires the use of mechanical means, for example using a beater 15 formed from a roller which drives in rotation a certain number of blades of resilient material, for example rubber, which, when they rotate, impart jolts to the portion of sheet 8 or 9 acting as the base (FIG. 4) or use may be made of water jets sprayed from nozzles disposed within the booth (FIG. 5) or possibly externally thereto, or use may even be made of microvibrators 17 arranged, in the same way as the beater 15, externally to and below the base section of the walls 8 and 9 (FIG. 6).

Figure 9:
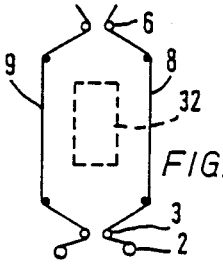
FIGS. 9 and 10 show similar views to that of FIG. 7, but relating to a variant of two opposite side walls of the booth.

FIG. 9 shows a configuration of the path of the sheets 8 and 9 where both the base and ceiling portions are strongly inclined to the horizontal.

Figure 13:
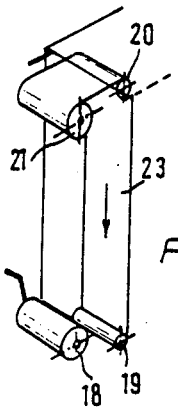
FIG. 13 is a diagrammatic perspective view of a structure acting as a side wall or half-wall designed to be positioned at one of the ends of a booth of the invention.
Figure 14:
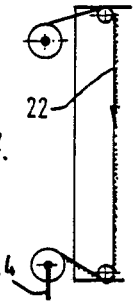
FIG. 14 is a side view of FIG. 13.

FIGS. 13 and 14 show identical groups of return rollers, two lower rollers 18 and 19 and two upper rollers 20 and 21, on which a respective strip or sheet of flexible material 23 is wound for closing the ends of the chamber (at which the products enter and leave the booth). The sheet 23 may be unwound from the upper roller 21 and wound on the lower roller 18 or vice versa and may be provided with a handle 24 for manual winding or, if desired, may be motorised.

In place of the two groups of rollers 18–21 it is possible to provide (FIGS. 15 and 16) a lower transverse roller 25 from which a single sheet or strip 26 is unwound and is returned by a roller 27 and intercepted by a pair of blades 28 mounted on a bar 29 so that they may be moved together or apart. The bar 29 is part of a mobile assembly on which there is also mounted a further return roller 30 which sends the inner strip of sheet 26 cut between the two blades 29 to a winding roller 31. The roller 30 and the bar 29 may be raised and lowered so as to bring them to a higher level when components or products which are not very tall, indicated generally by 32, enter the booth for coating, while they may be lowered in the case of longer components.

The two lateral sections of sheet or strip 26 outside of the blades 28 are deflected upwards by an upper return roller 34 to a second return roller 35 and are finally wound on the roller 36 actuated by the geared motor 37.

Figure 11:
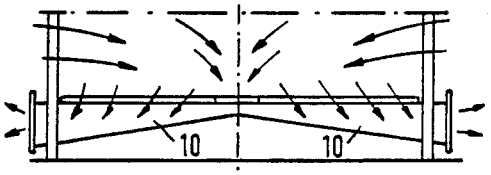
FIG. 11 is a similar view to FIG. 2 showing a variant of the conduit designed to suction and remove the paint powder from the interior of a booth of the invention.
Figure 12:
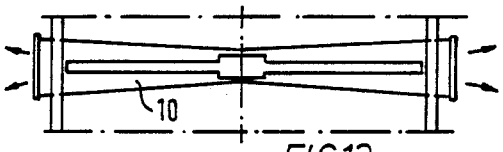
FIG. 12 is a diagrammatic view from the top of FIG. 11.

As can be seen the lower suction conduit 10 may be constructed as a single frustoconical component (FIG. 2) or in two opposite frustoconical pieces (FIGS. 11 and 12). It is possible to dimension the conduit such that the speed of the air and powder mixture is such as to make self-cleaning. In other words, the speed of the air in the conduit 10 does not allow the deposition of the powder on the internal side surfaces of the conduit itself since an axial stream of air taken from the cabin combined with a stream of air sucked through the longitudinal slot pass simultaneously through the conduit, the two air streams providing the air and powder mixture with a spiral movement at a speed which ensures the automatic internal cleaning of the conduit.

The variant with two frustoconical components (FIGS. 11 and 12) has the advantage that the air for the axial stream may be taken from the centre of the booth interior via a slot 11 with the further possibility of improving the balance of the input air volume which is uniform and identical at both inlet and outlet openings of the booth which tends, advantageously, to bring the powder towards the centre of the booth.

Figure 15:
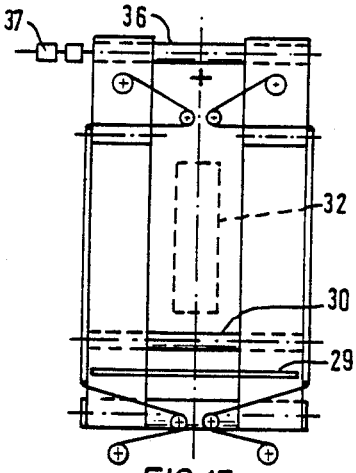
FIG. 15 shows a further embodiment of a short side wall for a booth of the invention.
Figure 16:
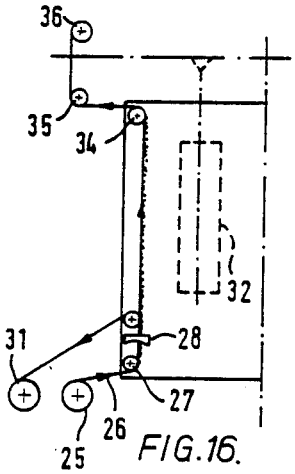
FIG. 16 is a simplified side view of FIG. 15.

When cleaning of the interior of the booth is necessary, for example when it is desired to change the colour of the powder avoiding any possibility of contamination between the previous and the successive colour, the ceiling or top surfaces and the surfaces of the side walls of the base or floor of the booth are replaced by causing the sheets 8 and 9 to slide for example about the upper rollers 7. The same operation is carried out at the short or stretched walls by winding them either on the rollers 18 or on the upper rollers 36. In this way all the walls of the booth, which is formed by four strips or sheets if the solution illustrated in FIGS. 15 and 16 is used or six sheets if the solution illustrated in FIGS. 13 and 14 is used, are replaced.

The only components which need to be cleaned separately are the cables or metal bars which may be manually or mechanically cleaned in a rapid way by wiping them with a cloth or passing them through a cleaning sleeve, this operation requiring only a few minutes.

The soiled strip or sheet wound on the rollers 7 and on the rollers 18 and 36 may be disposed of since this does not entail a heavy increase in the operating costs of the booth, as suitable low-cost sheet materials are commercially available.

After each change of walls 8, 9, 23 or 26 the openings 13 for the operator or the robot may be provided in a simple way by cutting the strip or sheet 8 at the most suitable location for the type of control means for the apparatus used with scissors or blades or hot wire. In other words, the booth makes it possible to select different numbers of openings 13 in different positions or sizes thereby improving manual operation and making the most of the fixed volume of air available. For example in the case of very tall components, two small openings 13 disposed at two different levels and used by two different operators are sufficient, one for the coating of the lower portion and the other for the coating of the upper portion of the components or product.

FIGS. 17 to 23 illustrate a chamber longer than the standard width of sheeting. It is therefore necessary to provide two sets of lining material 8,9 and associated rollers 3, 6 and bars 4, 5, one for each side of the chamber 1. Each set comprises a plurality (in the embodiment two) of separate sheets, side by side.

Figure 17:
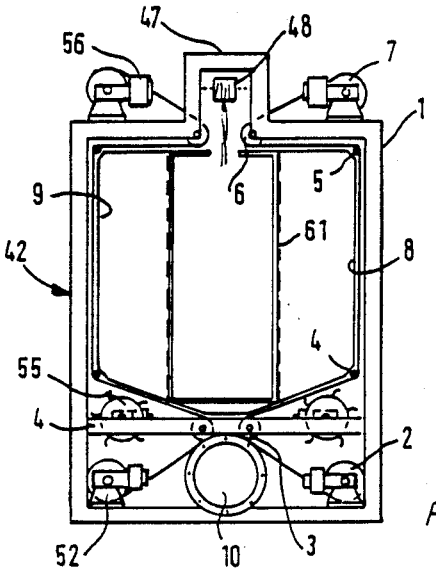
FIG. 17 is an end elevation.
Figure 18:
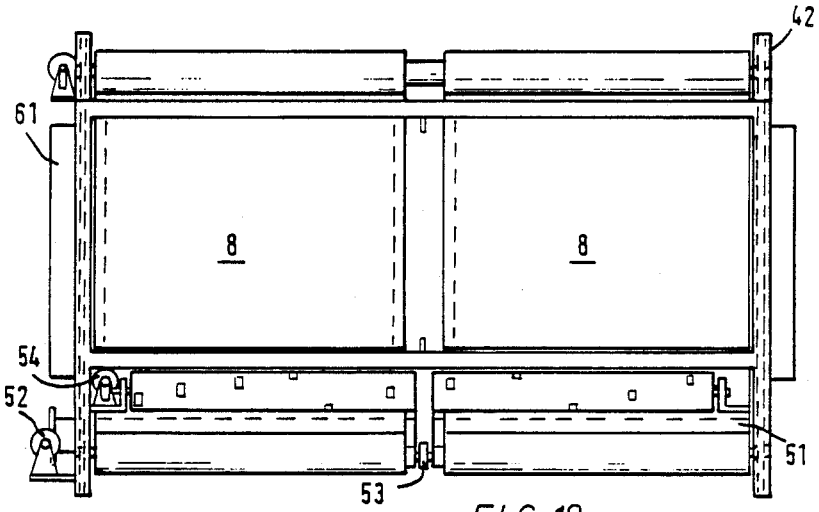
FIG. 18 is a side elevation of an elongated powder spray device.
Figure 19:
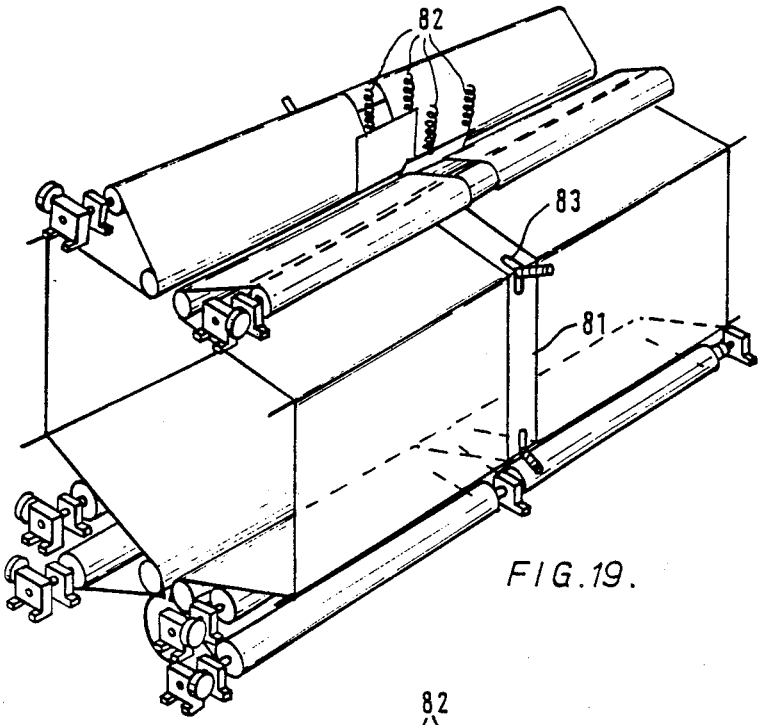
FIG. 19 is a perspective view of the apparatus of FIG. 17 with the framework removed for simplicity.
Figure 20:
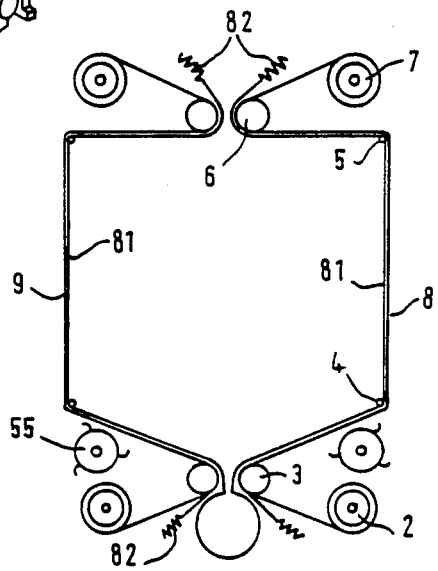
FIG. 20 is an end elevation similar to FIG. 17 again with the framework removed for simplicity and showing the tension arrangements for the centre sealing strip.
Figure 21:
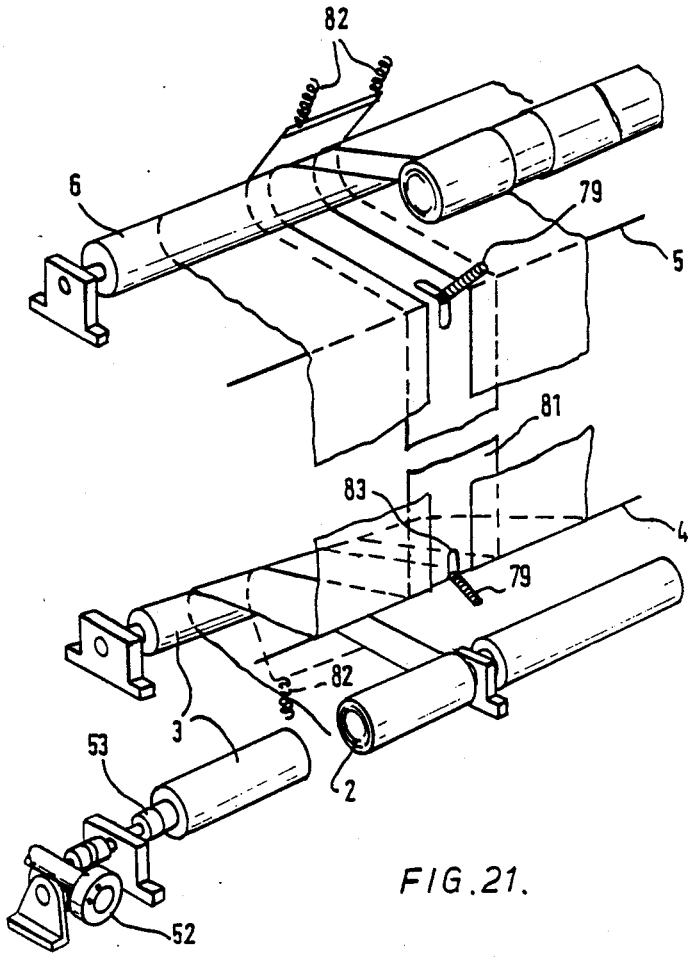
FIG. 21 is a detail of FIG. 3.
Figure 22:
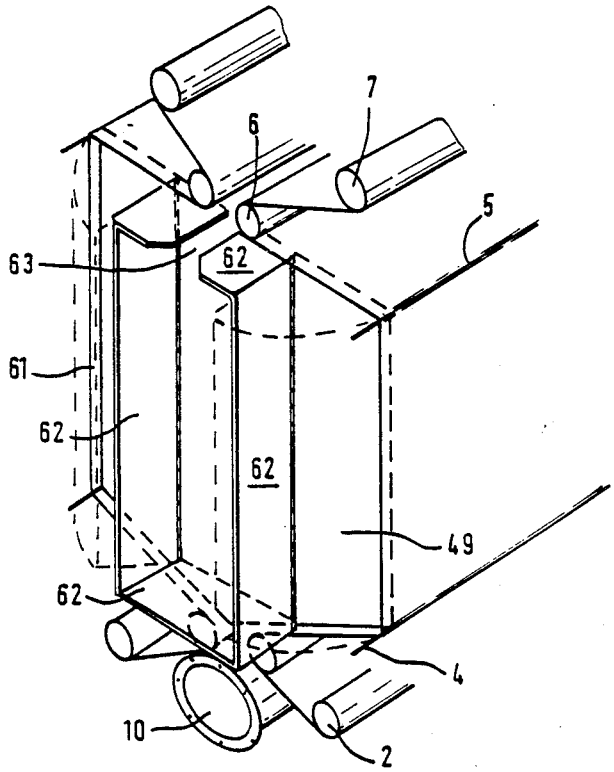
FIG. 22 is a detail of the near end of FIG. 3, showing the end wall of the compartment 11.

The framework 42 shown in FIGS. 17 and 18 is rectangualr, and has an upper portion defining the chamber 1 and a lower portion supporting the tapered extract duct 10 (the duct increasing in cross-section towards its outlet end). Two geared air motors 52 are located in the bottom corners of the framework driving rollers through quick-disconnect couplings to take up the used sheeting 8, 9. Each motor 52 drives two rollers 2 on the same axis, the rollers 2 being supported in bearings 53 between the rollers and at their extreme ends. Each roller 2 has a length equal to a standard width of polyethylene sheeting, such as 2.5 meters.

A cross bar 46 of the framework 42 is located above the tapered extract duct and below the chamber 1 and supports two further air motors 54 which drive beater rollers 55 which vibrate a lower inclined portion of the sheeting 8, 9 to dislodge powder deposited upon it.

At the top of the framework, two further geared air motors 56 are provided to drive rollers 7, around which the upper end of the polyethylene sheeting is wound. A central portion 47 of the framework houses a conveyor rail 48 from which products to be sprayed are hung and transported along the length of the chamber 1 and through product openings 61 at each end. Guards 62 extending parallel to the length of the chamber extend outwards from the product opening 61 around all four sides, leaving a gap 63 in the centre of the top for the conveyor supports. These guards 62 are of rigid plastics material and can be hinged apart about a vertical axes 64 at the edge of the product opening to allow access and cleaning. The end wall 49 of the chamber 1 is also of rigid plastics material and its edges are engaged by the polyethylene sheeting 8, 9 to prevent escape or ingress of materials to and from the chamber 1.

The sheeting 8, 9 extends from the motor driven upper roller 7 over an idler roller 6 beside the conveyor support path and then passes to a support wire 5 thereby defining the horizontal top of the chamber 11. The sheeting then passes vertically downwards to a second support wire 4, defining the outside edge of the chamber 11, and then slopes downwardly to a further idler roller adjacent the mouth of the tapered extract duct to define the floor of the chamber, after which it passes to the motor driven roller 2 at the base of the framework. When a length of sheeting 8,9 has been used up, most of the sheeting will be wound on the lower roller 2. The sheeting is cut and the roller 2 is removed by means of the quick-disconnect coupling from its bearings and replaced by a fresh roller whose free end is attached to the end of the old sheeting extending from the idler roller 3. The upper motor 56 is then driven to wind the new sheeting onto the upper roller 3 in one continuous drive. After each spraying cycle, the lower motor 52 is energised for a short period in order to present a new length of sheeting between the idler roller 6 and the idler roller 3 while at the same time the air motors 54 driving the beater rollers 55 are energised and air continues to be extracted from the tapered extract duct 10 in order that waste sprayed material can be dislodged from the sheeting 8, 9 and drawn away to the extractor (not shown).

The chamber 1 in this embodiment has a length approximately equal to twice the standrard width of sheeting. When such long chambers have been required until now, it has been necessary to seal together the adjoining edges of two lengths of sheeting so as to form one length of sheeting of double width, which is a difficult and costly operation. The apparatus of FIGS. 18 to 23 overcomes this difficulty by providing a tensioned central sealing strip 81 between the two lengths of sheeting. The strip is made from thin reinforced plastics sheet and overlaps the inside edges of the sheeting by a small amount. The extraction of air through the tapered extract duct 10 causes negative pressure within the chamber during operation so that the lengths of sheeting are drawn against the strip 81 and form an adequate seal therewith. The strip extends over the idler rollers 6 and 3 and the wires 4 and 5 and is tensioned at its upper and lower ends by springs 82. The wires 4 and 5 are supported from the framework by springs 79 extending through holes 83 in the strip 81. It will be realised that such a support of the centre point of the wires 4 and 5 is not possible in earlier devices which no sealing strip 81 is provided and the two lengths of sheeting are secured together, so that the present apparatus requires less tension in the wires 4 and 5 to support the sheeting around the chamber 1 and less strength in the framework 42.

Figure 23:
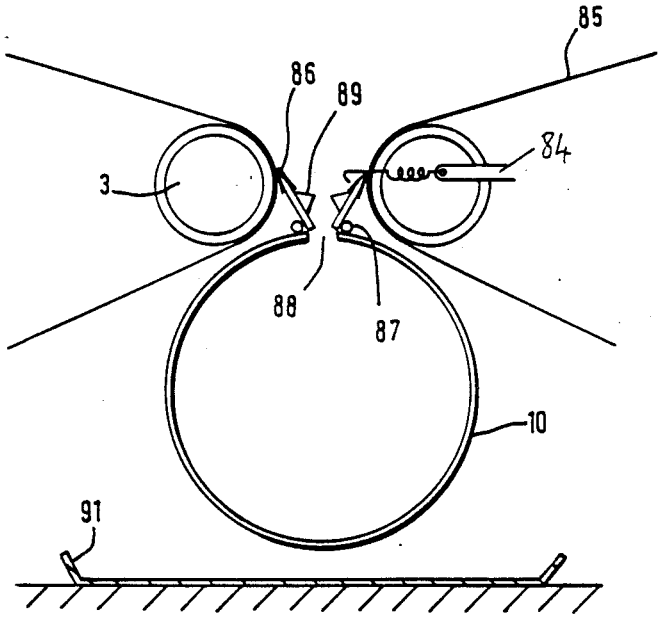
FIG. 23 is detail of the lower portion of the apparatus of FIG. 1.

FIG. 23 shows a detail of the lower idler rollers 3 and the extraction duct 19. The two lengths of sheeting slope downwardly at 85 towards respective idler rollers 3 to form the lower boundary of the chamber 11 and as they pass over the rollers 3, scrapers 86 with anti-scuffing material bear on the sheeting to remove deposited spray material (which may have been loosened by the beater rollers). The plates are hinged at 87 to respective sides of a slot 88 along the top of the extaction duct. Fingers 89 are provided on the plates to prevent the plates snapping shut due to the reduced air pressure in the duct, thus trapping an operative's fingers accidentally. Spring loaded catches 84 are provided to hold the plates 86 open. The anti-scuffing material reduces the danger of snagging of the sheeting around the bottom rollers during indexing. A powder catchment tray 91 is provided below the extraction duct 10 to receive any material which by-passes the extraction duct 10.

The outer walls of the apparatus may be sheeted in with lift-off panels not shown to protect personnel from the rotating rollers and beaters. Photoelectric or other suitable sensors are provided in the chamber to detect the presence of personnel within the booth and automatically shut down the extraction motors in the event of a positive sense.

All parts of the apparatus which may be contacted by operating personnel are positively earthed in order to prevent sparking from static discharges, which might be dangerous in powder deposition operations. Such parts of the apparatus may also be covered with plastics sheet to reduce the attraction of charged powder.

Materials and dimensions may also be varied in accordance with requirements.

The invention set out above may be modified and varied in many ways without departing from the protective scope of the claims set out below. Although, for example, the booth has been shown only with polygonal shapes which are symmetrical with respect to a vertical longitudinal plane, a large number of asymmetrical shapes are also possible. It can also be seen that the solution proposed by the present invention enables the complete automation of the whole internal cleaning operation for a spray booth for the application of surface coatings using powder products.

We claim:

1. An apparatus for performing powder deposition therein, comprising:

(a) a framework;

(b) first and second sheets of flexible material;

(c) supply means associated with said framework for selectively advancing the first and second of sheets of flexible material;

(d) guide means for directing the first and second sheets advanced by the supply means in respective first and second paths of travel about the sides and bottom of the framework to form a spray chamber, the first and second sheets respectively forming first and second spray chamber sidewalls and jointly cooperating to form a spray chamber floor, the floor terminating about a centrally disposed opening in the bottom of the spray chamber, each of the spray chamber sidewalls being substantially continuously joined to the spray chamber floor by a continuous portion of the sheets of flexible material;

(e) receiving means for collecting the first and second sheets of flexible material after said sheets have traveled about the respective paths of travel, and (f) means for withdrawing air from the spray chamber and moving the withdrawn air in a predetermined direction parallel to both said spray chamber sidewalls and said spray chamber floor, said withdrawing means including a duct in fluid communication with said centrally disposed opening, said duct having a constantly increasing crossectional area perpendicular to said predetermined direction, said duct directing the withdrawn air in said predetermined direction.

2. The apparatus of claim 1, further comprising cutting blade positioned to cut said sheet material into strips as it moves along said path; and strip guiding means to guide one of said strips along a different path to form an opening between said strips of sheet material.

3. The apparatus of claim 1 wherein each of the spray chamber sidewalls is formed of two moveable strips positioned side-by-side with a stationary strip positioned therebetween, said moveable and stationary strips defining said walls and said floor of said chamber; and said guide means being positioned so that they can guide said moveable strips longitudinally along side-by-side paths.

4. The apparatus of claim 1, wherein each of the spray chamber sidewalls is formed of two moveable strips positioned side-by-side with a stationary strip positioned therebetween, said moveable and stationary strips defining said walls and said floor of said chamber;

said guide means being positioned so that they can guide said moveable strips longitudinally along side-by-side paths; and further comprising a further strip of sheet material positioned inside said moveable strips in a manner such that said suction means can wipe said moveable strips against said further strip.

5. The apparatus of claim 3, wherein
said guide means comprise a member positioned at the joints of said walls and said floor; and
means to affix said members to said framework, said affixing means extending through said further strip.

6. The apparatus of claim 1, further comprising
means for scraping matter from said sheet material as it passes the centrally disposed opening in the bottom of the spray chamber.

7. An apparatus as recited in claim 1 wherein said first and second sheets further cooperate to form a spray chamber ceiling, said spray chamber ceiling being substantially continuously joined to each of the spray chamber sidewalls.

8. An apparatus as recited in claim 7 wherein said sheets form a gap in the spray chamber ceiling and further including a conveyor means for conveying articles, said conveyor means extending the gap for conveying articles through the spray chamber.

9. An apparatus as recited in claim 1 wherein said supply means includes a first and second supply locations and said receiving means includes a first and second receiving locations, the first sheet of extending between the first supply and receiving locations about the first path of travel and the second sheet extending the second supply and receiving locations about the second path of travel.

* * * * *

UNITED STATES PATENT AND TRADEMARK OFFICE

CERTIFICATE OF CORRECTION

PATENT NO. : 4,934,308

DATED : June 19, 1990

INVENTOR(S) : Geoffrey M. Boyce et al.

It is certified that error appears in the above-identified patent and that said Letters Patent is hereby corrected as shown below:

In claim 1, column 8, line 13, delete "of".

In claim 1, column 8, line 30, after "travel", delete ",", and insert therefor --;--.

In claim 2, column 8, line 42, before "cutting", insert --a--.

In claim 8, column 10, line 4, after "extending", insert --through--.

In claim 9, column 10, line 9, delete "of".

In claim 9, column 10, line 12, before "the second", insert --between--.

Signed and Sealed this

Eighteenth Day of February, 1992

*Attest:*

HARRY F. MANBECK, JR.

*Attesting Officer*

*Commissioner of Patents and Trademarks*